United States Patent [19]

Bateman, III

[11] 4,080,951

[45] Mar. 28, 1978

[54] ARCHERY BOW STRING SILENCER

[76] Inventor: Earle W. Bateman, III, 705 Robin Cir., Pasadena, Tex. 77502

[21] Appl. No.: 735,579

[22] Filed: Oct. 26, 1976

[51] Int. Cl.[2] ..... F41B 5/00

[52] U.S. Cl. ..... 124/92

[58] Field of Search ..... 124/92, 90, 23 R, 24 R, 124/86; 15/229 AC, 229 BC, 104.03, 104.05, 104.2, 104.16; 401/132; 46/165, 166

[56] References Cited

U.S. PATENT DOCUMENTS

| | | | |
|---|---|---|---|
| 1,545,510 | 7/1925 | Ostdiek et al. | 15/229 AC |
| 1,796,997 | 3/1931 | Keney | 46/165 |
| 1,897,381 | 2/1933 | Albright | 15/104.2 |
| 2,031,990 | 2/1936 | Turner | 401/132 |
| 2,756,453 | 7/1956 | Mattson | 15/229 BC |
| 3,612,029 | 10/1971 | Carroll | 124/92 |
| 3,756,214 | 9/1973 | Christen | 124/92 |

*Primary Examiner*—William R. Browne

*Attorney, Agent, or Firm*—Fulbright & Jaworski

[57] ABSTRACT

An archery silencer for use on the string and/or cable of an archery bow in which a plurality of lengths of fibrous material is secured to a flexible support. The silencer is connected to the string and/or cable adjacent each end of the string or cable to dampen the vibration of the string and/or cable and therefore reduce the sound caused by the vibrating bow string and/or cable. Preferably, the lengths of fibrous material are positioned closely together in a plane generally parallel to each other and the flexible support is a narrow elongate support positioned transverse to the lengths of material and secured to the material approximately midway between the ends of the lengths. Preferably, each end of the support extends beyond the lengths of the material for attachment of each end to the string and/or cable of the bow. Each end of the support may be longitudinally split for providing ends which can be tied to the string and/or cable.

7 Claims, 3 Drawing Figures

ARCHERY BOW STRING SILENCER

BACKGROUND OF THE INVENTION

Generally, archery silencers have been used in the past for attachment to the string of an archery bow for reducing the sound created by the bow string on the release of an arrow, which is desirable, particularly when hunting. The present invention is directed to an improved archery silencer which is simple, inexpensive and can be easily attached and removed from the bow string of a long bow or to the string and/or cable of a compound bow.

SUMMARY

The present invention is directed to an archery silencer for use on the string and/or cable of an archery bow which includes a plurality of lengths of fibrous material positioned generally parallel to each other and which the lengths of material are secured to a flexible support. The support may include ends free of the material for attachment of the free ends to the string and/or cable of a bow.

Still a further object of the present invention is the provision of an archery silencer which includes a plurality of lengths of fibrous material positioned closely together in a plane and positioned generally parallel to each other and supported from a narrow elongate flexible support positioned transverse to the lengths of material wherein each end of the support extends beyond the lengths of material for attachment of each end to the string and/or cable of a bow. In addition, each end of the support may be longitudinally split for providing ends which can be readily tied to the bow string and/or bow cable.

Yet a still further object of the present invention is the provision of an archery silencer utilizing a plurality of lengths of yarn which are sewed to a flexible elongate leather support which can be wrapped around the bow string and/or cable and secured thereto so that the yarn forms a soft ball of material which dampens the vibration ofthe bow string and cable but yet does not interfere with or damage the bow.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present invention is useful on any type of bow, such as a compound bow which has cables as well as a bow string, for purposes of illustration only, the present invention will be described as used on a simple long bow.

Figure 1:
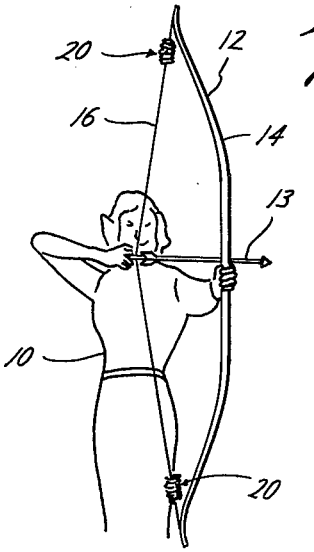
FIG. 1, is an elevational view of an archer using a conventional long bow and arrow in which the silencer of the present invention is attached adjacent each end of the bow string.

Referring now to the drawings, and particularly to FIG. 1, an archer 10 is shown utilizing a conventional type archery long bow 12 and arrow 13. The bow 12 includes the limb 14 and bow string 16. Generally, when the bow string 16 and arrow 14 are released, the string 16 creates a noticeable audible sound which is undesirable, particularly when hunting. Similarly, on a compound bow (not shown) the cables, as well as the string, may produce undesired sounds.

The present invention is directed to an archery silencer, generally indicated by the reference numeral 20 which is attached to the bow string and/or cable such as string 16, preferably adjacent each end. Thus the silencer is attached to each end of the string 16 for deadening the vibration of the string 16 thereby lessening the noise produced by the string 16 without interfering with the operation of the bow and arrow.

Figure 2:
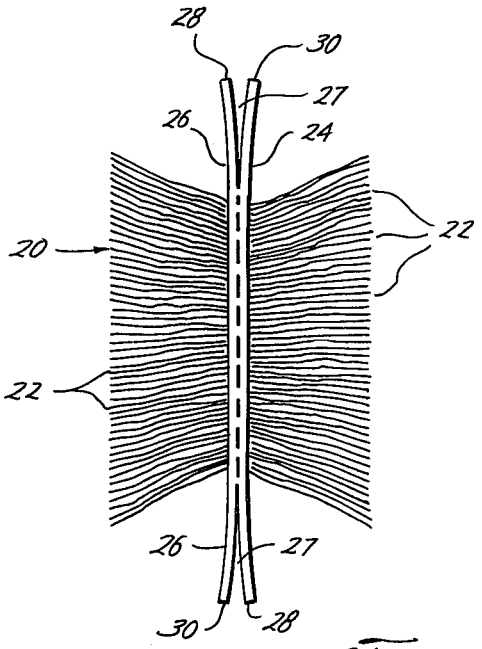
FIG. 2 is an enlarged elevational view of the invention of the present invention as manufactured.

Referring now to FIG. 2, the archery silencer of the present invention is illustrated which includes a plurality of lengths of fibrous material 22 which are positioned closely together in a plane and generally parallel to each other. While any suitable soft pliable fibrous material can be used such as acrylic or cotton, ordinary yarn has proved satisfactory. A narrow elongate flexible support 24 is provided which is secured to and supports the lengths of fibrous material 22. One suitable method of connection of a support 24 to the lengths of material 22 is by sewing. Preferably, the support 24 is connected approximately midway between the ends of the lengths of material 22. Preferably, the ends 26 of a support 24 extend beyond the lengths of material 22 to provide ends which are free of the fibrous material. The free ends 26 extend beyond the lengths of material 22 to provide a convenient structure for attachment to the string 16 of the bow 12. Preferably, the ends 26 of the support 24 are longitudinally split to provide two portions 28 and 30 which can be utilized to tie the support 24 to the string 16. The support 24 is wide enough for providing attachment to the lengths of fibrous material 22 but is narrow so as to be suitably wound around and connected to the string 16 of the bow 12 and is flexible for attachment to the string 16. The support 24 may be suitably formed of any desirable material but a soft leather material has been found to be satisfactory.

Figure 3:
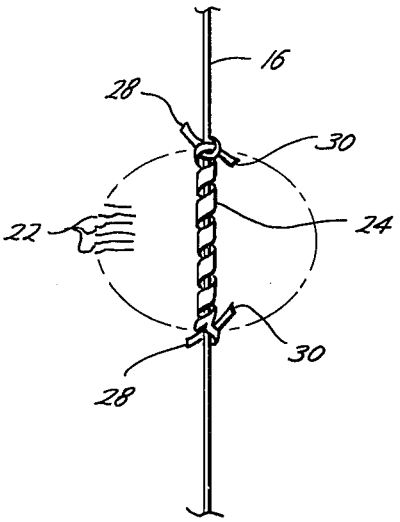
FIG. 3 is an enlarged elevational view of the archery silencer of the present invention showing one form of attachment to the string or cable of a bow.

Referring now to FIG. 3, one method of attachment of the archery silencer 20 to a bow string 16 is best seen. The support 24 is wrapped around the string 16 in helical fashion with the lengths of material on the outside and the portions 28 and 30 of each free end 26 of the support 24 is tied to the string 16. The lengths of fibrous material 22 form a soft ball-like projection from the string 16 which can contact the bow 14 upon release of the string 16 and will dampen the vibration of the string 16, but will not interfere with the operation of the bow and arrow, and will not damage either the bow 14 or the string 16.

The longitudinal slit 27 in the free ends 26 of the support 24 may be omitted if desired. In fact, the free ends 26 need not be tied to the bow string 16 if the string is of the multi-strand type in which the string strands can be separated and the free ends 26 merely inserted between strands since the tension in the string 16 will keep the strands in a tight gripping engagement with the ends 26 of the support 24. Another method of attachment is the use of a conventonal clamp clip (not shown) for connecting the silencer 20 to the string and/or cable of a bow. A still further method of attachment is to connect several of the lengths of material 22 instead of the ends 26 to the string 16.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. An archery silencer for use on the string and/or cable of an archery bow comprising, a plurality of lengths of fibrous material positioned generally parallel to each other, a flexible support secured to one side of the lengths of fibrous material, and said support including means at each end of said support for securely attaching said silencer on an archery bow string to reduce vibration of a bow string.

2. The apparatus of claim 1 wherein each end of said support being free of the lengths of fibrous material for attachment to each end to the string of a bow.

3. The apparatus of claim 1 wherein the support is an elongate narrow support positioned transverse to the lengths of material between the ends of said lengths.

4. An archery silencer for use on the string and/or cable of an archery bow comprising, a plurality of lengths of yarn positioned closely together in a plane generally parallel to each other, a flexible narrow elongate support means positioned transverse to the lengths of yarn for securing one side of the lengths of yarn approximately midway between the ends of said length of yarn, said support means having end means extending beyond the lengths of yarn for attachment of each end to the string of a bow so that said lengths of yarn may dampen vibration of a bow string.

5. The apparatus of claim 4 wherein each said end means being longitudinally split for providing ends which can be tied to a low string.

6. The apparatus of claim 4 wherein the support means is leather and is sewed to the lengths of yarn.

7. In combination with a vibratory string and/or cable of an archery bow, an archery silencer comprising, a plurality of lengths of fibrous material, a flexible narrow elongate support means positioned transverse to the lengths of material for securing thereto one side of the lengths at a position approximately midway between the ends of said lengths, said support means being helically wound about a bow string and/or cable causing fibrous material to form a fibrous ball-like shape, and said support means having end means for securing same to a bow string and/or cable to dampen the vibration of a bow string.

* * * * *

UNITED STATES PATENT OFFICE

CERTIFICATE OF CORRECTION

Patent No. 4,080,951 Dated March 28, 1978

Inventor(s) Earle W. Bateman, III

It is certified that error appears in the above-identified patent and that said Letters Patent are hereby corrected as shown below:

Column 4, line 15, change "low" to --bow--

Column 4, line 27, after "causing" insert -- said--

Signed and Sealed this

*Eighth* Day of *August 1978*

[SEAL]

*Attest:*

RUTH C. MASON
*Attesting Officer*

DONALD W. BANNER
*Commissioner of Patents and Trademarks*